United States Patent [19]

Geren

[11] 4,207,819

[45] Jun. 17, 1980

[54] HELICOPTER DESTROYER

[75] Inventor: Keith E. Geren, San Diego, Calif.

[73] Assignee: The United States of America as represented by the Secretary of the Navy, Washington, D.C.

[21] Appl. No.: 272,808

[22] Filed: Apr. 12, 1963

[51] Int. Cl.[2] ..... F42B 22/42

[52] U.S. Cl. ..... 102/18 MS; 367/1; 367/2

[58] Field of Search ..... 102/18, 19.2, 70.2 P; 340/5 D, 2, 3; 328/5; 367/1, 2

[56] References Cited

U.S. PATENT DOCUMENTS

| | | | |
|---|---|---|---|
| 2,341,351 | 2/1944 | Barkley | 102/19.2 |
| 2,441,030 | 5/1948 | Page | 102/19.2 |
| 2,958,280 | 11/1960 | Gilfillan et al. | 102/18 |
| 3,015,096 | 12/1961 | Debraine et al. | 340/5 D |
| 3,164,659 | 1/1965 | Abrams | 340/5 D |

*Primary Examiner*—Charles T. Jordan
*Attorney, Agent, or Firm*—Louis A. Miller; Paul N. Critchlow; Don D. Doty

EXEMPLARY CLAIM

1. A helicopter destructor comprising in combination,
   a hydrophone channel,
   a microphone channel,
   a barometer channel,
   an AND gate connected to the outputs of said hydrophone, microphone, and barometer channels,
   an explosive means, and
   means connected to the outputs of said hydrophone channel and said AND gate for detonating said explosive means when a trio of signals are simultaneously applied to the respective inputs of said AND gate.

12 Claims, 5 Drawing Figures

HELICOPTER DESTROYER

The invention described herein may be manufactured and used by or for the Government of the United States of America for governmental purposes without the payment of any royalties thereon or therefor.

The present invention relates generally to decoying destructors and in particular is an improved method and means for decoying and timely destroying a helicopter engaged in sonar target echo-search activities.

In the past, decoys which present false targets were used to lure enemy aircraft and other vessels involved in sonar target search activity to some predetermined position or area of vulnerability, whereupon they would be attacked by other air, surface or subsurface vessels and "killed". Although for some purposes such prior art devices were and still are satisfactory, unfortunately their use is somewhat limited and sometimes impractical due to the auxiliary vessels, weapons, and equipment required in order to destroy or incapacitate the decoyed enemy craft. In addition, such auxiliary craft, weapons, and equipment were usually placed in jeopardy during such combat operations because they, too, would usually be "visible" to the enemy or at least be sufficiently exposed so that the enemy had cognizance of their presence and approximate location. Thus, in most instances, such arrangements made it possible and perhaps facilitated self-defensive or retaliatory measures to be taken by said enemy or, in any event, the decoying operation would be rendered considerably less effective. Moreover, the prior art method of decoying an enemy aircraft or other vessels tied up said destructive type of auxiliary equipment and, hence, prevented its deployment to more useful locations during tactical combat maneuvers. Furthermore, the prior art methods and means for destroying sonar operating helicopters do not appear to attract enemy helicopters to a vulnerable position while giving indications that the decoy is not within target range.

The present invention overcomes most of the disadvantages of the aforementioned prior art devices in that it combines both decoy luring and "kill" operations in a unitary device which, due to its physical and operational nature, is considerably less vulnerable, less hazardous, less expensive, less difficult to operate, and more expendable than the aforesaid devices of the prior art.

It is, therefore, an object of this invention to provide a decoy which lures and destroys an enemy craft.

Another object of this invention is to provide an improved method and means for luring a helicopter within destructive range of a decoy while causing said helicopter to think the decoy is a target located at some other place.

Still another object of this invention is to provide an improved method and means for attracting an enemy aircraft to a vulnerable position while giving the indication that it is still not within the target range of the aircraft's weapons.

A further objective of this invention is to provide an improved decoy which gives the appearance to an enemy vessel that it is a target that is moving away or escaping therefrom.

A further objective of this invention is to provide a unique enemy craft decoy which contains a new and unusual combination of response characteristics to an enemy sonar echo-searcher so as to improve "kill" effectiveness thereof.

Still another object of this invention is to provide an improved decoy-destructor employing an automatic disabler to permit detonation only when it is disposed at the position of optimum effectiveness.

Another object of this invention is to provide an expandable decoy-helicopter destroyer that is easily and economically manufactured, maintained, and used.

Other objects and many attendant advantages of this invention will be readily appreciated as the same becomes better understood by reference to the following detailed description when considered in conjunction with the accompanying drawings in which like reference numerals designate like parts throughout the figures thereof and wherein.

Figures 1, 2:
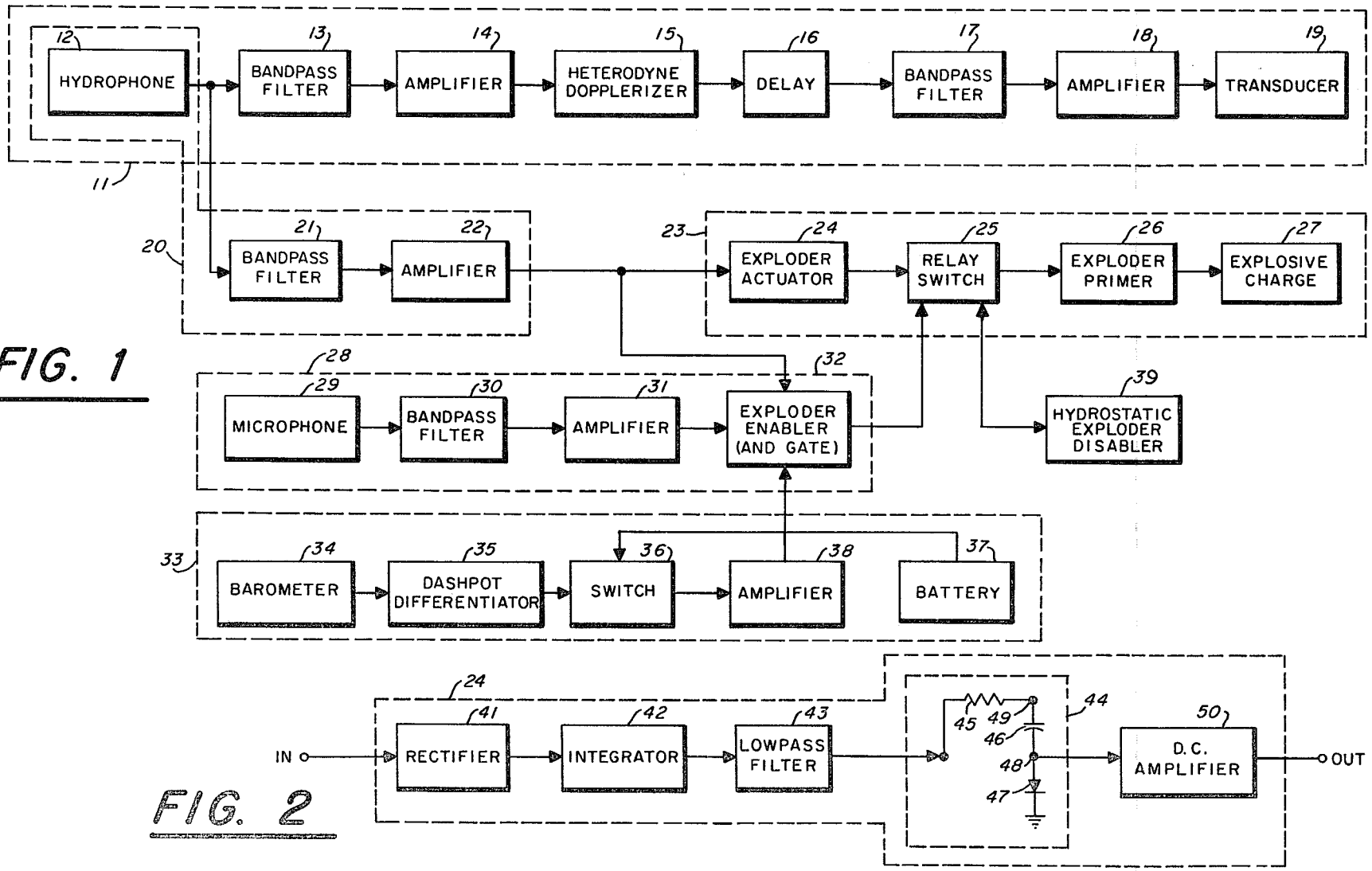
FIG. 1 is a block diagram of the helicopter destroyer system constituting this invention.
FIG. 2 is a combination block diagram and schematic diagram representation of the exploder actuator component of the device of FIG. 1.

Referring now to FIG. 1, the invention is disclosed as containing a down-dopplerized echo repeater system 11 which includes a hydrophone 12 as the input thereto. Although hydrophone 12 is primarily intended to be of the electroacoustical transducer type which is responsive to sonar signals that are received from an enemy echo-search sonar system, it should be understood that any appropriate transducer may be substituted therefor in order to expedite operations under any operational circumstances. The output of hydrophone 12 is fed through a 5 to 30 kilocycle per second bandpass filter 13 and an amplifier 14 to the input of a heterodyne dopplerizer 15. Although any preferred dopplerizer may be used in the subject invention as dopplerizer 15, a convenient type which may be used is disclosed in the patent application of Keith E. Geren, entitled "Dopplerized Echo-Repeater", filed Mar. 29, 1963, Ser. No. 269,211, co-pending in the U.S. Patent Office. In that case, the dopplerizer portion thereof is disclosed as being either an up-dopplerizer or a down-dopplerizer as desired, necessitating only that design changes of the skilled artisan be made in order to convert from one to the other. In the instant helicopter destroyer invention, it is preferred without limitation that the down-dopplerizer version of the aforesaid dopplerized echo-repeater patent application be incorporated therein as heterodyne dopplerizer 15. The output of heterodyne dopplerizer 15 is applied to the input of a delay 16 which may be any pertinent acoustical delay line having appropriate signal delay characteristics such as, for example, a one-third second delay time. The output of delay 16 is fed through a 5 kilocycle to 30 kilocycle per second bandpass filter 17 and an amplifier 18 to the input of a sonar projector type transducer 19 adapted for broadcasting acoustical energy throughout a predetermined subaqueous medium. As a matter of practicality, hydrophone 12 and transducer 19 may be similar devices and used for their respective operations, due to the fact that they are both reversible electroacoustical types of energy converters which will both receive and transmit according to their particular application. Again, although said hydrophone 12 and transducer 19 are primarily intended to be used to receive and broadcast energy respectively within sea water while being submerged therein during sonar combat or countermeasure activities, it should be understood that other transducers may be employed as would be appropriate for use in any other predetermined environmental medium for any given operational purposes, since making the proper selection thereof and frequencies pertinent thereto would be well within the purview of one skilled in the art.

The output of hydrophone 12 is also supplied to the input of a 150 to 250 cycle per second bandpass filter 21 before being amplified in amplifier 22 and supplied to one of the inputs of a detonation system 23. Actually, in this particular representation, series connected hydrophone 12, bandpass filter 21, and amplifier 22 are considered to constitute hydrophone channel 20 and, thus, the output of amplifier 22 constitutes the output of hydrophone channel 20. It is this output which is applied to the input of an exploder actuator 24 of the aforesaid detonation system 23. Because exploder actuator 24 is unique in itself, it is disclosed in FIG. 2 below and will be discussed in connection therewith. The output of exploder actuator 24 is connected through the switch portion of a relay switch 25 which in turn is connected to an exploder primer 26. Exploder primer 26 may be of any conventional type which is preferably physically connected to an explosive charge 27 to facilitate the detonation thereof. Exploder charge 27 may be any charge that is appropriate for any given operational circumstances, but trinitrotoluene ($C_6H_2(CH_3)(NO_2)_3$) or fuliminate of mercury ($Hg(ONC)_2$) may also be used therefor, if so desired, since they both function in a satisfactory manner for the purposes intended.

For the sake of convenience and simplicity and economy of manufacture, hydrophone channel 20 makes use of hydrophone 12 as the input element thereof. However, if so desired, a separate and distinct hydrophone may be incorporated therein, thus allowing each of the echo-repeater system and the hydrophone channel to have its own input hydrophone.

Figure 3:
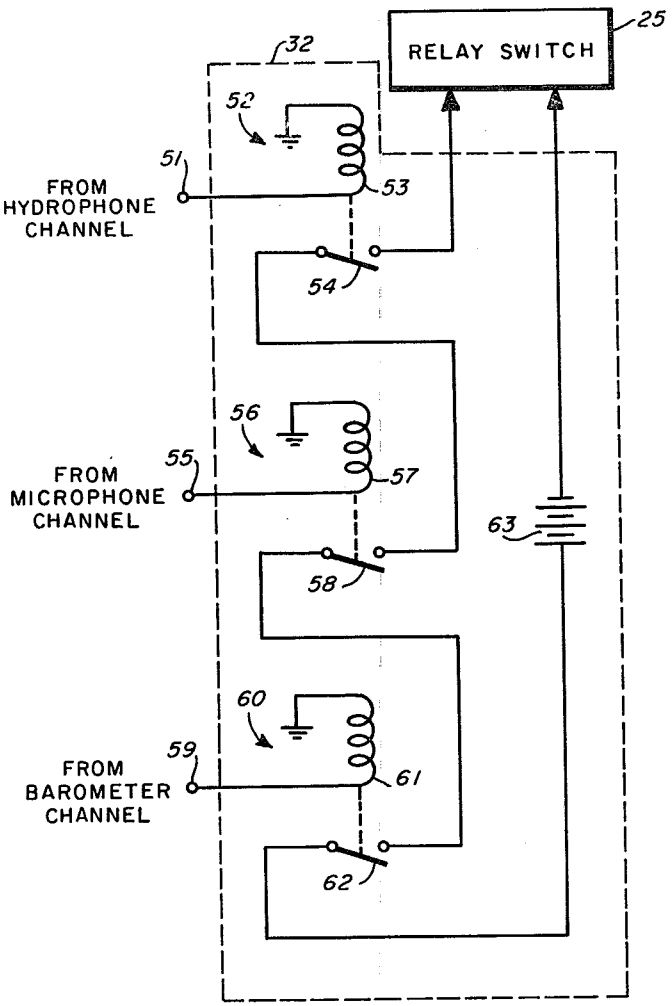
FIG. 3 is a schematic diagram representation of the exploder enabler component of the device of FIG. 1.
Figure 5:
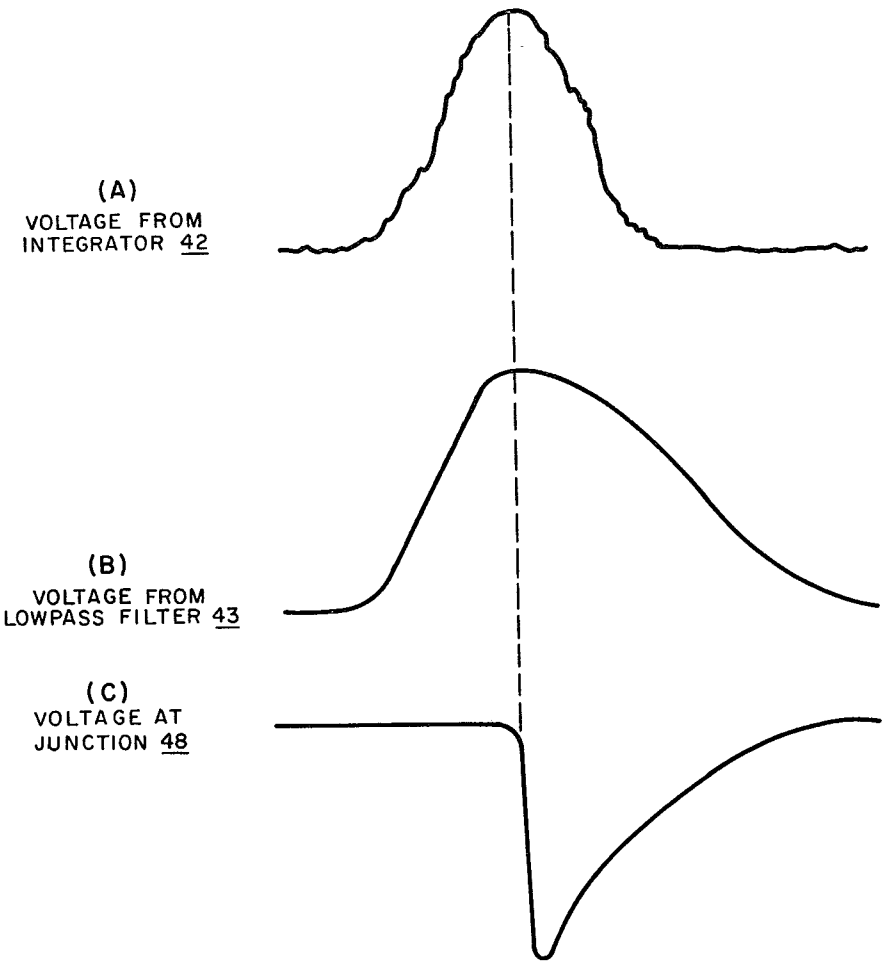
FIG. 5 is an exemplary graphical representation of voltages respectively emanating from various components of the subject invention.

A microphone channel 28 consists of a microphone 29, the output of which is fed through a bandpass filter 30 and an amplifier 31 to one of the inputs of an AND gate exploder enabler 32. Because an exemplary version of an exploder enabler which may be employed as exploder enabler 32 is depicted in FIG. 3 and will subsequently be discussed in connection therewith, further comment thereon at this time will be deferred until later. As can be seen from FIG. 1 exploder enabler 32 has three inputs one of which is received from the aforementioned output of amplifier 31, another of which is received from the output of amplifier 22 of hydrophone channel 20, and the other of which is received from the output of a barometric channel 33, the structure of which will now be explained.

Barometric channel 33 consists of a barometer 34 having a mechanical dashpot type of differentiator 35. The output of dashpot differentiator is mechanically coupled so as to timely actuate a switch 36 when the proper barometric pressure differential occurs within a predetermined time interval. The closing of the contacts of switch 36 causes an electrical signal to be supplied by a power supply such as a battery 37 to an amplifier 38, from which it is then fed as one of the inputs to exploder enabler 32.

A hydrostatic exploder disabler 39 is connected to the aforementioned relay switch 25 of detonator system 23 in such manner as to open the switch portion of relay switch 25 when the subject decoy is submerged in sea water or flooded by a passing wave thereof, thereby preventing the detonation of charge 27 at an inopportune moment when the explosion thereof would be cushioned by said water, producing little or no destructive effect.

The output of exploder enabler 32 is applied to one of the inputs of the aforementioned switch 25 of detonator system 23.

Although exploder enabler 32 is exemplarily depicted in FIG. 3, it should be understood that any device that produces an output signal when all of the three input signals are present may be so employed. For instance, a typical AND gate would ostensively serve this purpose very well. Likewise, any other preferred arrangement of conventional elements may be substituted therefor if so desired, as long as the aforesaid operational characteristics are available.

Referring now to FIG. 2, exploder actuator 24 is shown as having its input supplied to a detector type rectifier 41, the output of which is coupled to an integrator 42. The output of integrator 42 is fed through a low pass filter 43 to the input of an amplitude receding detector 44. As can be seen, said amplitude receding detector 44 consists of a resistor 45 connected in series with a capacitor 46 and a diode 47 which, in turn, is connected to ground. A junction 48 which is the interconnecting junction of the aforesaid capacitor 46 and diode 47 acts as the output terminal of amplitude receding detector 44 and this, of course, is coupled to the input of a DC amplifier 50, the output of which is the output of the exploder actuator.

FIG. 3 illustrates an exemplary embodiment of exploder enabler 32 mentioned previously. A first input terminal 51 receives its input signals from the aforesaid hydrophone channel 20 and is coupled to a solenoid 52 and in particular to the inductance portion 53 thereof. A normally open switch portion 54 is closed by the energization of said inductance portion 53 of solenoid 52. The output from the aforesaid microphone channel 28 is supplied to a terminal 55 which in turn connects with another solenoid 56 and in particular connects to an inductance portion thereof 57. Solenoid 56 likewise has a normally open switch 58 which is closed by the energevation of said inductance portion 57. The output from the barometer channel is received at an input terminal 59 which is also coupled to a solenoid 60 and, in particular, is connected to an inductance portion 61 thereof. Like each of the foregoing solenoids, solenoid 60 contains a normally open switch 62 which is closed whenever inductance portion 61 is energized by the presence of an output signal from said barometer channel. A power supply such as a battery 63 is connected in series with the aforesaid switches 54, 58, and 62 and, of course, as can readily be seen, the circuit is completed by connecting the aforesaid switching circuit to relay switch 25 of the aforementioned detonator system 23. Again, it should be understood, that the circuit of FIG. 3 is exemplary only and any conventional device which provides the proper output signal whenever the outputs from the hydrophone channel, the microphone channel, and the barometer channel are present at the input thereof.

Briefly, the operation of the subject invention will be disclosed now in connection with FIGS. 1 through 5.

Figure 4:
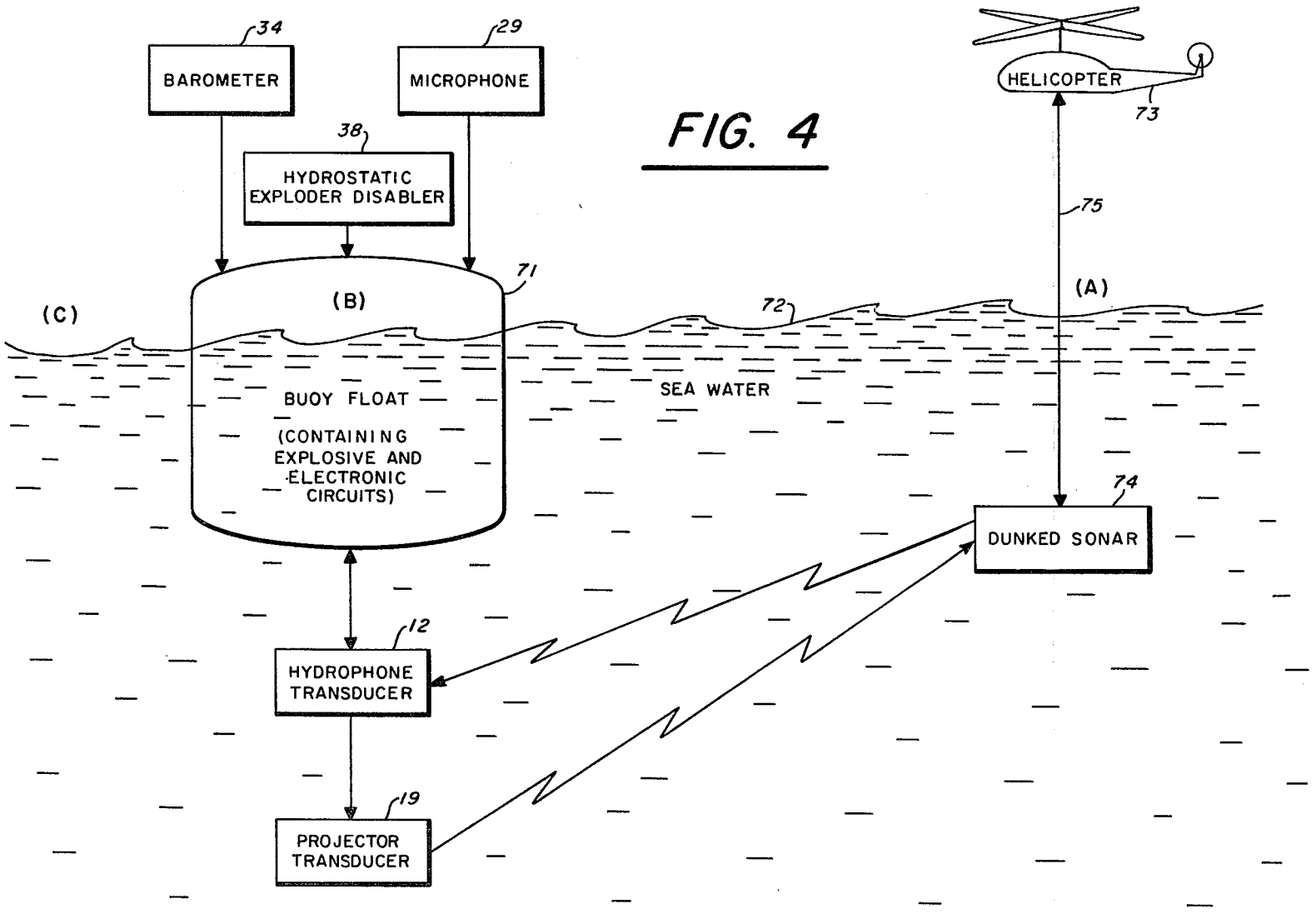
FIG. 4 is an exaggerated pictorial view of the subject invention as it may be employed during aircraft destruction maneuvers or operations.

FIG. 4 illustrates by means of a generalized pictorial view the procedure which is employed to effectively use the subject invention. The electronic and electrical devices depicted in FIGS. 1 through 3 are contained in the interior of a buoy type of incasement 71 which is designed to be waterproofed so that it will float on the surface of sea water, fresh water, or the like, or any other predetermined environmental medium. Inasmuch as the subject invention is primarily intended for decoy and combat maneuvers at sea, said buoy 71 and its associated electrical and electronic equipment should be so designed as to withstand such a hostile environment without adversely affecting the operation thereof. In actual maneuvers, said buoy is positioned at some predetermined location in the ocean where it is believed that it will be effective in attracting helicopters or other craft that is sonar echo-searching for targets to destroy. As is shown in the preferred use illustration depicted in FIG. 4, a helicopter 73 would ordinarily be flying at a low altitude over the surface of the ocean while dunking its sonar system or at least the transducer portion thereof into the water by means of a payout cable. Even though it is entirely possible that helicopter 73 may travel at a rather rapid pace, it is anticipated that under ordinary circumstances the speed thereof would be relatively slow and perhaps be of the order of 15 to 25 knots. As said helicopter performs its target search operations, it broadcasts acoustical energy throughout the sea water which is picked up by the subject invention and broadcast back to him in a dopplerized manner as to deceive the helicopter into believing that buoy 71 is actually a moving submarine target that is moving away from or escaping from the vicinity, so as to prevent or reduce the effectiveness of the enemy helicopters anti-submarine weapons. Accordingly, hydrophone 12, which picks up the target search signal from sonar 74, simultaneously causes it to be broadcast back thereto by means of echo-repeater system 11 and further processes the received sonar signal in hydrophone channel 20 to effect one of the steps of arming the explosive charge portion of the invention. In so doing the output from hydrophone 12 becomes an electrical signal which is proportional to the received acoustical signal and this is passed through the bandpass filter 21 so as to eliminate all frequencies other than those that exist in the 150 to 250 cycle per second passband thereof. The output of passband filter 21 is then amplified to a useful amplitude level before being supplied to exploder actuator 24 and exploder enabler AND gate 32.

As the helicopter approaches the destructor buoy, the noise increases and this increased noise is picked up by means of microphone 29 which likewise converts said noise signal into a comparable electrical signal which is filtered to eliminate all frequencies except those within the 150 to 250 cycle per second passband by means of bandpass filter 30, after which it is amplified to a useful amplitude level and supplied to one of the inputs of exploder enabler AND gate 32. Likewise, as helicopter 73 approaches destructor buoy 71, the barometric pressure at the immediate top thereof increases due to the down wash of air from the rotating helicopter blades. Barometer 34, which, for example, may be of the aneroid type, senses this atmospheric pressure change and converts it to an equivalent mechanical motion. This motion is applied by means of the conventional arm or pen arm to dashpot differential 35 where it is controlled so as to produce another predetermined motion in event a given barometric pressure change occurs within a predetermined short period of time. This, of course, eliminates the possibility of actuation of switch 36 by ordinary, natural barometric changes, rather than the rapid change which occurs only when a helicopter is present. Effectively, then, the barometer dashpot differential combination produces a mechanical output force that is proportional to the rate of change of barometric pressure and this force is then used to actuate and close a switch. Although dashpot differentials are conventional per se and any appropriate conventional dashpot may be employed in this invention, it may be noteworthy that the differential action may, for example, be obtained by having the output arm of the barometer act as a pivotal arm with the dashpot located at the fulcrum and switch 36 located at the other end. This, in effect, provides a moving fulcrum which changes position readily during slow motion of said arm as it is actuated by the barometer. However, in event of a rapid motion of said arm as a result of a rapid barometer pressure change, said fulcrum is held sufficiently rigid and in place by the dashpot to transfer the force applied thereto to the outer end of said arm and thereby provide the force thereat necessary to actuate switch 36.

The closing of switch 36 then causes battery 37 to supply an electrical signal to amplifier 38, where it is amplified to a useful level before being applied as another of the input signals to exploder enabler AND gate 32.

Because enemy helicopter 73 may be attracted to the destructive range of buoy destructor 71 but never actually pass right over the top thereof, it was necessary to cause said destructor to explode at such time when the distance between buoy destructor 71 and said enemy helicopter 73 is a minimum during any given tactical maneuvers. In other words, as helicopter 73 approaches buoy destructor 71 it may for some reason or another actually be diverted or turn away therefrom before making the complete attack thereon, and if said helicopter is within the destructive range of the subject invention, it is at the point of turning away that optimum destructive results are produced during that particular tactical maneuver. Hence, it becomes necessary to produce a device which will actuate the destructive charge detonator system at such time as the amplitudes of the received signals therefrom began to recede from their maximum level as the helicopter moves to a more remote position. For this purpose, the hydrophone channel was selected as being the most sensitive for such an operation. The output thereof is thus supplied to the input of exploder actuator 24. In this particular case, the input to exploder actuator 24 is actually rectifier 41 which provides the proper polarity of signal. This signal is then passed through integrator 42 so that the increasing amplitude of the received signal would automatically be summed and stored before being passed on to a voltage-smoothing lowpass filter 43. The typical output from integrator 42 is graphically represented by the exemplary waveform shown in FIG. 5A. As can be seen, although said waveform is only an example of the type that may be obtained, the amplitude thereof becomes greater as the helicopter approaches the destructor buoy. But, because this curve is still in a somewhat rough condition, the output of integrator 42 is passed on to low pass filter 43 where it is smoothed to a waveform similar to that shown in FIG. 5B, then differentiated and rectified by amplitude receding detector 44 to produce a waveform somewhat comparable to the waveform shown in FIG. 5C.

As can be seen, the triggering signal is effected by the disclosed arrangement of resistor 45, capacitor 46, and diode 47 which, of course, constitutes the aforementioned amplitude receding detector 44. And due to the detection as mentioned above by means of diode 47 as a result of obtaining the output signal at junction 48, the output signal therefrom is timely created by the recession of the amplitude of the waveform of FIG. 5B which, in turn, is proportional to the distance between helicopter 73 and destructor buoy 71 at any given instance during the particular combat maneuver involved. The output of amplitude receding detector 44 is then amplified to a useful level by means of a direct current amplifier 50 before being applied as one of the inputs to the aforesaid relay switch 25 of the detonator system.

When the switch portion of relay 25 is closed as a result of receiving a signal from the output of exploder enabler AND gate 32, it causes an electrical current to pass through an exploder primer which, in turn, causes the ignition thereof. Of course, as is conventional in the explosive art, exploder primer 26 is then employed to detonate explosive charge 27.

In order to prevent the explosion of the subject destructor at such time when the enemy echo-searching helicopter 73 is not within range thereof, and in order for the subject destructor buoy not to be exploded by signals from other or perhaps natural causes not intended to effect the explosion thereof, the subject invention was so designed as to only be armed during that time when the appropriate signals are received by the hydrophone, microphone, and barometric transducer at predetermined respective signal levels simultaneously. Hence, it can be seen, that when such signals are being received, the outputs from hydrophone channel 20, microphone channel 28, and barometric channel 33 energize the solenoids of the exploder enabler AND gate 32 depicted in FIG. 3. The energization of solenoids 53, 57, and 61 thereby effects the closure of series connected switches 54, 58, and 62, which of course, causes the circuit to be closed between battery power supply 63 and relay switch 25. This likewise, in turn, energizes the inductive portion of relay switch 25 to cause the switch portion thereof to be closed, thereby completing the electrical path between the output of exploder actuator 24 and the input of exploder primer 26. But, of course, if any one of the aforementioned trio of input signals is not present or is not present in sufficient amplitude to be operative, the detonator system of the subject invention never becomes enabled and therefore never becomes susceptible to being exploded.

Hydrostatic exploder disabler 39 is likewise coupled to relay switch 25 in such a manner that the switch portion thereof is not closed or enabled in event that the entire buoy is submerged within the sea water for some particular reason or in event that it is being flooded at any given instant by a large wave. Being submerged in sea water at the time of detonation, would considerably reduce the explosive effectiveness of the charge and, consequently, such a hydrostatic disabler device is preferred (although not absolutely necessary) in order to obtain optimum operations. Although shown only as block 39 in the subject disclosure, such hydrostatic exploder disablers are conventional in the art and may take the physical characteristics of merely being a shorting switch which is shorted by sea water which, in turn, shorts out the inductance portion of relay 25, thereby preventing its becoming energized by the output signal from exploder enabler AND gate 32, and hence eliminating any possibility of electrical continuity from existing between exploder actuator 24 and exploder primer 26 at that time.

Once enemy helicopter 73 comes close enough to destructor buoy 71 to trigger its electrical and electronic systems, it is in a position of vulnerability and it will subsequently be destroyed the moment that it either passes over said buoy or turns away therefrom causing the amplitude of the aforementioned activating ambient signals to begin to recede in amplitude. At this instant, the helicopter destructor constituting this invention will explode and the explosive force of the charge causes the destruction of said helicopter to such an extent that it is completely "killed" or disabled and put out of the combat operation going on at that particular time.

Obviously many modifications and variations of the present invention are possible in the light of the above teachings. It is, therefore, to be understood that, within the scope of the appended claims, the invention may be practiced otherwise than as specifically described.

What is claimed is:

1. A helicopter destructor comprising in combination, a hydrophone channel, a microphone channel, a barometer channel, an AND gate connected to the outputs of said hydrophone, microphone, and barometer channels, an explosive means, and means connected to the outputs of said hydrophone channel and said AND gate for detonating said explosive means when a trio of signals are simultaneously applied to the respective inputs of said AND gate.

2. A helicopter destructor comprising in combination, a hydrophone channel having a hydrophone included therein, a microphone channel, a barometer channel, an AND gate connected to the outputs of said hydrophone, microphone, and barometer channels, an explosive means, means connected to the outputs of said hydrophone channel and said AND gate for detonating said explosive means when a trio of signals are simultaneously applied to the respective inputs of said AND gate, and means connected to the output of the hydrophone of said hydrophone channel for receiving a sonar signal from an aqueous medium and broadcasting a dopplerized version thereof back throughout a predetermined portion thereof.

3. A helicopter destructor for operation in an aqueous medium comprising in combination, a hydrophone channel, a microphone channel, a barometer channel, an exploder enabler AND gate connected to the output of said channels, an exploder actuator coupled to the output of said hydrophone channel, an explosive means, switch means connected between said exploder actuator, said explosive means, and to said exploder enabler AND gate adapted for being closed when an electrical signal is present at the output of said AND gate, and means connected to said switch means for preventing the closure thereof when said helicopter distructor is submerged in water.

4. The device of claim 3 wherein said exploder enabler AND gate includes a trio of series-connected switches which are respectively closed as a result of electrical signals being present at the outputs of the aforesaid hydrophone, microphone, and barometer channels.

5. The invention according to claim 3 further characterized by a sonar echo-repeater system connected to the aforesaid hydrophone channel in such manner as to be responsive to an acoustical signal received from the aforesaid aqueous medium.

6. The device of claim 5 wherein said sonar echo-repeater system comprises, a hydrophone for receiving acoustical energy from within a subaqueous medium and converting same into an electrical signal proportional thereto, a first filter coupled to the output of said hydrophone, a first amplifier connected to the output of said filter, a heterodyne dopplerizer coupled to the output of said amplifier, an acoustical delay line connected to the output of said heterodyne dopplerizer, a second filter connected to the output of said acoustical delay line, a second amplifier coupled to the output of said second filter, and an electroacoustical transducer means coupled to said second amplifier for converting the electrical output signal therefrom into an acoustical signal proportional thereto and broadcasting said acoustical signal throughout a predetermined portion of the aforesaid subaqueous medium.

7. A helicopter destructor comprising in combination, first means for receiving an acoustical signal from within a subaqueous medium, means coupled to said first acoustical signal receiving means for dopplerizing the signal received thereby, means coupled to said dopplerizing means for broadcasting said dopplerized signal throughout a predetermined portion of said subaqueous medium, first means coupled to the output of said first acoustical signal receiving means for passing a predetermined band of frequencies, second means for receiving an acoustical signal from the environment above the surface of said subaqueous medium, second means coupled to the output of said second acoustical signal receiving means for passing a predetermined band of frequencies, a barometric differential pressure switch means for producing an electrical output signal whenever the ambient barometric pressure increases a predetermined amount in a given period of time, an exploder enabler AND gate having a trio of inputs and an output with said trio of inputs respectively connected to the outputs of said first and second predetermined band of frequency passing means and the aforesaid barometric differential pressure switch means, an exploder actuator effectively coupled to the output of said first predetermined band of frequency passing means, relay switch means having a solenoid portion and a switch portion with the switch portion being closed when said solenoid portion is energized, with the switch portion thereof being coupled to the output of said exploder actuator, and the solenoid portion thereof being connected to the output of said exploder enabler AND gate, an exploder primer means coupled to the switch portion of said relay switch means, and an explosive charge means connected to said exploder primer means in such manner as to be detonated thereby.

8. The invention according to claim 7 further characterized by means connected to said relay switch means for disabling same in order to prevent ignition of said exploder primer when said helicopter distructor is submerged in water.

9. The device of claim 7 wherein said exploder actuator comprises, a rectifier, an integrator coupled to the output of said rectifier, a lowpass filter coupled to the output of said integrator, and an amplitude receding detector coupled to the output of said lowpass filter.

10. The device of claim 9 wherein said amplitude receding detector consists of, an input terminal, a resistor coupled to said input terminal, a capacitor connected to said resistor, a ground, a diode connected between said capacitor and said ground, and an output terminal connected to the interconnection of said diode and the aforesaid capacitor.

11. A transponder for echo-repeating received signals comprising in combination, a first transducer for converting received signals into electrical output signals proportional thereto, a first bandpass filter coupled to the output of said first transducer, a heterodyne dopplerizer effectively connected to the output of said bandpass filter, a delay line coupled to the output of said heterodyne dopplerizer, a second bandpass filter connected to the output of said delay line, and a second transducer effectively connected to said second bandpass.

12. Means for actuating predetermined utilization equipment at the time of incipient amplitude recession of an input signal thereto comprising, a rectifier, an integrator coupled to the output of said rectifier, a lowpass filter connected to the output of said integrator, a resistor coupled to the output of said lowpass filter, a capacitor connected to said resistor, a ground, a diode connected between said capacitor and said ground, and an output terminal effectively connected to the interconnection of the aforesaid capacitor and diode.

* * * * *